US008247098B2

(12) United States Patent
Gestermann et al.

(10) Patent No.: US 8,247,098 B2
(45) Date of Patent: Aug. 21, 2012

(54) ELECTROCHEMICAL CELL

(75) Inventors: Fritz Gestermann, Leverkusen (DE); Andreas Bulan, Langenfeld (DE); Hans-Dieter Pinter, Wermelskirchen (DE)

(73) Assignee: Bayer MaterialScience AG, Leverkusen (DE)

( * ) Notice: Subject to any disclaimer, the term of this patent is extended or adjusted under 35 U.S.C. 154(b) by 1941 days.

(21) Appl. No.: 11/106,658

(22) Filed: Apr. 15, 2005

(65) Prior Publication Data

US 2005/0277016 A1 Dec. 15, 2005

(30) Foreign Application Priority Data

Apr. 17, 2004 (DE) ..... 10 2004 018 748

(51) Int. Cl.
*H01M 4/00* (2006.01)

(52) U.S. Cl. ..... 429/51; 429/122; 429/50

(58) Field of Classification Search ..... 429/34, 429/38, 25, 50, 304, 51, 122
See application file for complete search history.

(56) References Cited

U.S. PATENT DOCUMENTS

| | | | | |
|---|---|---|---|---|
| 4,702,972 | A * | 10/1987 | Matsumoto | 429/450 |
| 6,117,286 | A | 9/2000 | Shimamune | |
| 2004/0101740 | A1* | 5/2004 | Sanders | 429/40 |
| 2010/0291420 | A1* | 11/2010 | Kazacos et al. | 429/50 |

FOREIGN PATENT DOCUMENTS

| | | | |
|---|---|---|---|
| EP | 1033419 | | 9/2000 |
| WO | WO-98/24949 | | 6/1998 |
| WO | WO-01/57290 | | 8/2001 |
| WO | WO0157290 | * | 8/2001 |
| WO | WO-03/042430 | | 5/2003 |

* cited by examiner

*Primary Examiner* — Jennifer Michener
*Assistant Examiner* — Monique Wills
(74) *Attorney, Agent, or Firm* — Connolly Bove Lodge & Hutz LLP

(57) ABSTRACT

An electrochemical cell comprising: (i) an anode half-cell with an anode, (ii) a cathode half-cell with a cathode, (iii) an ion-exchange membrane arranged between the anode half-cell and the cathode half-cell, the anode and/or the cathode comprising a gas diffusion electrode, (iv) a gap between the gas diffusion electrode and the ion-exchange membrane, (v) an electrolyte feed inlet above the gap, (vi) an electrolyte drain beneath the gap, (vii) a gas inlet, (viii) a gas outlet, and (ix) an electrolyte holding vessel comprising an overflow connected with the electrolyte feed inlet.

19 Claims, 2 Drawing Sheets

ELECTROCHEMICAL CELL

CROSS REFERENCE TO RELATED APPLICATIONS

This application claims priority from German Application No. 102004018748.7 filed Apr. 17, 2004, the content of which is incorporated herein by reference in its entirety.

BACKGROUND OF THE INVENTION

1. Field of the Invention

The present invention relates generally to an electrochemical cell including an anode half-cell with an anode, a cathode half-cell with a cathode and an ion-exchange membrane arranged between the anode half-cell and the cathode half-cell, wherein the anode and/or the cathode is a gas diffusion electrode. The instant invention furthermore relates to processes for electrolyzing an aqueous solution of alkali chloride.

2. Description of Related Art

WO 01/57290 discloses an electrolysis cell with a gas diffusion electrode, in which a porous layer is provided in a gap between the gas diffusion electrode and the ion-exchange membrane. Under the effect of gravity, an electrolyte flows downwards from above via a porous layer through the gap. The porous layer according to WO-A 01/57290 may include foams, wire meshes or the like.

U.S. Pat. No. 6,117,286 likewise describes an electrolysis cell with a gas diffusion electrode for electrolyzing a sodium chloride solution, in which a layer of a hydrophilic material is located in a gap between the gas diffusion electrode and the ion-exchange membrane. The layer of hydrophilic material preferably has a porous structure, which contains a corrosion-resistant metal or resin. Meshes, woven fabrics or foams may be used as the porous structure. Sodium hydroxide, the electrolyte, flows downwards under gravity via the layer of hydrophilic material to the bottom of the electrolysis cell.

EP-A 1 033 419 furthermore discloses an electrolysis cell with a gas diffusion electrode as the cathode for electrolyzing a sodium chloride solution. In the cathode half-cell, the electrolyte, which is separated from the gas space by a gas diffusion electrode, flows downwards. A hydrophilic, porous material through which the electrolyte flows is also provided. Porous materials disclosed include metals, metal oxides or organic materials, provided that they are corrosion-resistant.

Electrolysis cells with a gas diffusion electrode from the prior art, generally do not ensure that the gap between the gas diffusion electrode and the ion-exchange membrane can be completely filled with electrolyte due to the fact that the porous material is present. This is disadvantageous because as a result, zones arise in the gap and gas forms therein and accumulates. No electric current can flow in these zones. Thus, electricity flows exclusively through electrolyte-filled zones in the gap, resulting in a higher local current density, which in turn gives rise to a higher electrolysis voltage. If the gas collects on the ion-exchange membrane, the membrane will not be completely saturated and may be damaged due to the absence of electrolyte.

The use of porous layers furthermore has the disadvantage that any gas which has entered the porous structure can only get back out again with difficulty. Thus gas can accumulate within the porous layer, and as such gives rise to the above-stated disadvantages. Under operating conditions, gas from the gas space can also pass out from the gas space through the gas diffusion electrode and into the gap. Gas diffusion electrodes furthermore have a tendency to allow increasing quantities of gas to pass through at unsaturated points, and as a result the effect is amplified.

SUMMARY OF THE INVENTION

An object of the present invention was accordingly to provide an electrolysis cell which avoids certain disadvantages of the prior art.

In accordance with the present invention, there is provided an electrochemical cell comprising: (i) an anode half-cell with an anode, (ii) a cathode half-cell with a cathode, (iii) an ion-exchange membrane arranged between the anode half-cell and the cathode half-cell, the anode and/or the cathode comprising a gas diffusion electrode, (iv) a gap between the gas diffusion electrode and the ion-exchange membrane, (v) an electrolyte feed inlet above the gap, (vi) an electrolyte drain beneath the gap, (vii) a gas inlet, (viii) a gas outlet, and (ix) an electrolyte holding vessel comprising an overflow connected with the electrolyte feed inlet.

In further accordance with the present invention, there is provided a process for electrolyzing an aqueous alkali halide solution in an electrochemical cell comprising: supplying an electrolyte in excess from an electrolyte holding vessel to an electrolyte feed inlet such that the electrolyte flows from an electrolyte feed inlet into a gap between an electrode and an ion exchange membrane, and from said gap into an electrolyte drain and flows away from the inlet via an overflow.

Additional objects, features and advantages of the invention will be set forth in the description which follows, and in part, will be obvious from the description, or may be learned by practice of the invention. The objects, features and advantages of the invention may be realized and obtained by means of the instrumentalities and combinations particularly pointed out in the appended claims.

BRIEF DESCRIPTION OF THE DRAWINGS

The invention is illustrated in greater detail below with reference to the attached drawings. In the drawings.

DETAILED DESCRIPTION OF A PREFERRED EMBODIMENT

Figure 1:
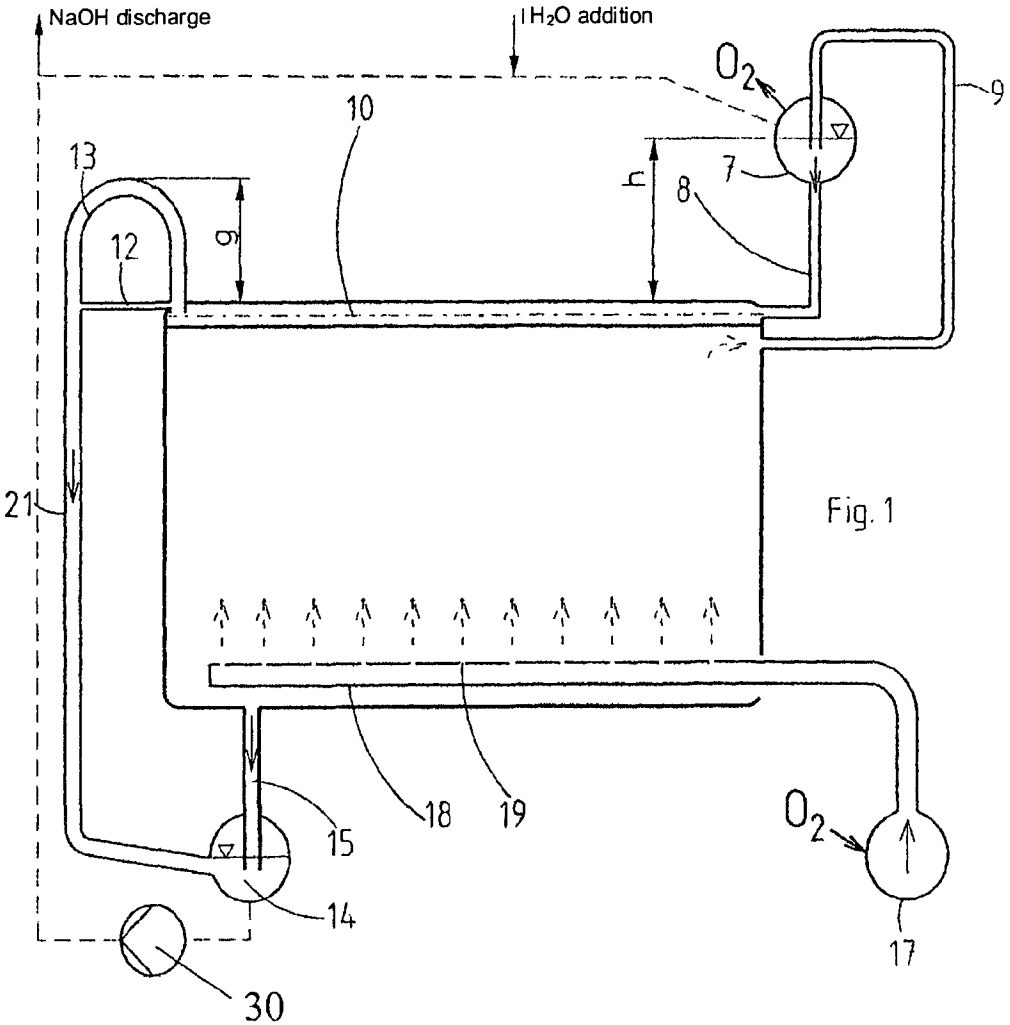
FIG. 1 is a schematic longitudinal section through an embodiment of the electrolysis cell according to the invention

The present invention provides an electrochemical cell including an anode half-cell with an anode, a cathode half-cell with a cathode and an ion-exchange membrane arranged between the anode half-cell and the cathode half-cell, the anode and/or the cathode being a gas diffusion electrode. There is also provided a gap arranged between the gas diffusion electrode and the ion-exchange membrane, an electrolyte feed inlet above the gap and an electrolyte drain beneath the gap together with a gas inlet and gas outlet. Furthermore the electrolyte feed inlet is connected with an electrolyte holding vessel and comprises an overflow.

When an electrochemical cell according to the present invention is in operation, the electrolyte generally flows from the top downwards through the half-cell in the gap between the gas diffusion electrode and the ion-exchange membrane. Accordingly, in an advantageous electrolysis cell according to the instant invention, an electrolyte feed inlet is preferably provided above the gap and an electrolyte drain is preferably provided beneath the gap. As such, the gap is preferably completely filled by the flowing electrolyte. Remaining space in the half-cell behind the gas diffusion electrode, i.e. space on the side of the gas diffusion electrode remote from the ion-exchange membrane, which is denoted "the gas space," is thus filled with gas. Gas is preferably supplied to the gas space through the gas inlet and exhausted through the gas outlet.

The electrolyte feed inlet preferably forms a horizontal channel above the gap. The channel preferably extends over an entire width of the electrochemical cell. With the assistance of a channel-shaped electrolyte feed inlet, the electrolyte may accordingly generally be supplied uniformly over an entire width from above and into the gap, between the gas diffusion electrode and the ion-exchange membrane. To this end, the electrolyte feed inlet preferably has, for example, numerous openings which are directed downwards, through which, when the electrolysis cell is in operation, electrolyte flows into the gap. Instead of a plurality of openings, or in addition thereto, a slot- or slit-shaped opening may optionally be provided which preferably extends over an entire width of the gap. The electrolyte leaves the half-cell via the electrolyte drain and advantageously passes into an electrolyte collecting vessel. The electrolyte drain should generally be immersed in the electrolyte collecting vessel in order to minimize or avoid uncontrolled flow of gas from cell to cell via the electrolyte collecting vessel (in the event that a plurality of electrolysis cells are optionally connected together to form an electrolyzer).

An electrochemical cell according to the present invention is also known as a falling-film cell. Trouble-free operation thereof is often vitally dependent on providing the electrode with a reliable supply of electrolyte. In the case of an industrial electrolysis cell, the width be any desirable amount, and advantageously, may amount to more than about 2000 mm. This means that the electrode should generally be uniformly supplied with electrolyte over its entire width. Any electrode can be employed as desired. If a gas diffusion electrode is used as the electrode, gas from the gas space may pass through the gas diffusion electrode into the gap between the gas diffusion electrode and the ion-exchange membrane. It is preferable that one is able to reliably exhaust gas from the gap, as accumulation of gas in the gap should be avoided in most cases.

It is advantageous to provide the gas diffusion electrode with a uniform supply of electrolyte. Electrolyte preferably flows from the top downwards in the gap between the (gas diffusion) electrode and the ion-exchange membrane. This can be achieved in the electrolysis cell according to the invention for example, by the electrolyte feed inlet being connected with an electrolyte holding vessel and having an overflow. In a first embodiment, the electrolyte holding vessel is preferably arranged from about 30 to about 200 cm above the electrolyte feed inlet. When the electrolysis cell is in operation, the electrolyte typically flows out from the holding vessel into the electrolyte feed inlet. From the electrolyte feed inlet, the electrolyte flows, for example, via a slot-shaped opening into the gap between the gas diffusion electrode and the ion-exchange membrane.

In a further embodiment, the electrolyte holding vessel is preferably connected with the electrolyte feed inlet via a pump. In this embodiment, the electrolyte holding vessel may in principle be arranged in any desired position, for example, beneath the electrochemical cell. With the assistance of the pump, the electrolyte can be pumped at a desired admission pressure into the electrolyte feed inlet.

The electrolyte holding vessel may, in principle, be connected with the electrolyte feed inlet at any desired point. Thus, for example, it can be connected at one end of the electrolyte feed inlet.

If two or more electrolysis cells according to the invention are connected to form an electrolyzer, a single electrolyte holding vessel or multiple holding vessels may be used to supply all the electrolysis cells of the electrolyzer. Alternatively, each of the electrolysis cells may be equipped with a separate holding vessel, or two or more can share the same vessel if desired.

According to the instant invention, the electrolyte feed inlet preferably has an overflow. The overflow preferably has a height of from 0 to about 190 cm, particularly preferably of from about 1 to about 190 cm above the entry into the gap. In principle, the height of the overflow may be less than 1 cm; in this case the overflow is preferably at the same height as the entry into the gap. The overflow ensures that when the electrolysis cell is in operation, a certain quantity of electrolyte always accumulates in the electrolyte feed inlet. A decisive factor with regard to the height of the overflow is that the overflow preferably causes a quantity of electrolyte to build up in the electrolyte feed inlet, which is sufficient to provide the gap with a continuous supply of electrolyte generally over its entire width. To this end, the electrolyte preferably flows out from the electrolyte holding vessel into the electrolyte feed inlet in exactly or close to such a quantity wherein the overflow just barely overflows. A valve, a diaphragm, for example, a perforated disk, or the like may optionally be provided in the supply line which connects the electrolyte holding vessel with the electrolyte feed inlet. Causing an overflow stream of electrolyte from the electrolyte feed inlet makes it possible to generally supply the gap uniformly with electrolyte over the entire width of the electrode and reliably to exhaust gas from the gap. The provision of an overflow stream generally prevents the electrolyte level in the electrolyte feed inlet from dropping so far that the falling film of electrolyte breaks up in the gap. The overflow furthermore helps to ensure, inter alia, that gas bubbles which rise out of the gap into the electrolyte feed inlet are conveyed away with the electrolyte.

The overflow may, in principle, be positioned at any desired point along the electrolyte feed inlet. It may, for example, be provided at one end of the electrolyte feed inlet or at any desired location.

The overflow may, for example, comprise an overflow channel. Such an overflow channel may be arranged in any desired way such as either outside or inside the cathode half-cell. Excess electrolyte, which does not flow downwards into the gap, preferably flows out of the electrolyte feed inlet into the overflow channel and, from the overflow channel, is exhausted from the electrolysis cell, for example, into an electrolyte collecting vessel. The overflow channel may, for example, comprise a hose or tube, optionally with a perforated diaphragm or the like. The overflow channel can be, for example, directed upwards. The channel also may, for example, be constructed as a U-shaped channel, such that excess electrolyte initially fills a "leg" of the U-shaped overflow channel which is connected with the electrolyte feed inlet and then flows away via the second leg of the U. Any other desired shape could also be employed.

If the overflow channel is directed upwards, for example if it is U-shaped or otherwise, the height between the upper vertex of the upwardly directed overflow channel and the electrolyte feed inlet (hereinafter denoted "g") is preferably from 0 to about 190 cm, particularly preferably from about 1 to about 190 cm. The same applies analogously to any shape of overflow.

In a further embodiment, the overflow channel may also be constructed as a standpipe or vertical shaft, or a channel or the like within the electrolysis half-cell. The excess electrolyte is preferably exhausted from the electrolysis cell by this means and directed, for example, into a collecting vessel. The entry into the standpipe is preferably at least about 1 cm above the level of the gap, so that the gap is capable of being uniformly supplied over the entire width of the cell.

The electrolyte exhausted via the overflow is preferably directed into a collecting vessel. The exhaust may, for example, be achieved by a channel, for example, a hose or tube, arranged outside the electrolysis cell. The collecting vessel may be connected with the holding vessel, such that the electrolyte may be pumped from the collecting vessel into the holding vessel and be resupplied to the electrolysis cell.

The quantity of electrolyte which flows from the holding vessel into the electrolyte feed inlet can be any desired amount and generally depends on the difference in height between the electrolyte liquid level in the holding vessel and the liquid level in the electrolyte feed inlet. The difference in height defined in this manner is hereinafter denoted "h". The liquid level in the electrolyte feed inlet is in turn generally dependent on the height of the overflow, which determines how much electrolyte builds up in the electrolyte feed inlet. If the electrolyte is pumped from the holding vessel into the electrolyte feed inlet, the quantity of electrolyte which is delivered into the electrolyte feed inlet is typically dependent on the delivery head h of the pump.

In a further embodiment of the electrolysis cell according to the present invention, alternatively, or in addition to an upwardly directed overflow channel or a standpipe, shaft, channel or the like, it is also possible to provide an overflow channel which is substantially horizontal or any other shape. Excess electrolyte may also be exhausted from the electrolysis cell if desired via a horizontally arranged overflow channel or any other type of arrangement.

If more electrolyte is added than can flow away via the, overflow channel and the gap, the pressure of the electrolyte increases in the channel-shaped electrolyte feed inlet above the gap. The pressure in the electrolyte feed inlet may be adjusted such as by selection of the height g of the overflow channel. At a higher pressure, more electrolyte may be passed through the gap. In this manner, the gap may be exposed to a different quantity of electrolyte at different current densities. This is advantageous, for example, if at elevated current densities the electrolyte becomes highly concentrated, which may result in damage to the ion-exchange membrane. This may, however, be minimized or avoided if the electrolyte is passed through the gap at a higher volumetric flow rate. The pressure in the electrolyte feed inlet may purposefully be adjusted by varying the ratio of the differences in height to one another, i.e. the ratio of h to g. Care is generally taken to ensure that g is less than or equal to h in many cases.

An advantage of an electrolysis cell according to the invention resides in the fact that, thanks to the simple principle of a free overflow, it is possible to uniformly supply the gap between the (gas diffusion) electrode and the ion-exchange membrane and reliably to exhaust gas from the gap. Furthermore, the flow rate in the gap may readily be controlled by the overflow. Moreover, it is possible to minimize or avoid a dynamic increase in pressure in the gap between the gas diffusion electrode and the membrane, which can be hazardous to the gas diffusion electrode and could be caused, e.g., by direct supply of the electrolyte by a pump without a functioning free overflow of the electrolyte feed inlet.

Oxygen, air or oxygen-enriched air (hereinafter denoted "oxygen" for simplicity) is supplied from a receptacle (also denoted a gas collecting vessel), preferably beneath the gas space, into the gas space of the half-cell with a gas diffusion electrode. Supply preferably proceeds uniformly over an entire width of the half-cell via a gas distribution tube as the gas inlet. Unconsumed oxygen can be exhausted from the gas space in an upper part of the half-cell via a gas outlet. Alternatively, the gas may also be supplied in the upper part and exhausted in the lower part of the electrolysis half-cell or any alternative desired arrangement.

In one embodiment, the gas outlet is connected with the electrolyte holding vessel, such that the electrolyte holding vessel simultaneously serves as a gas collecting vessel for excess oxygen. In this case, unconsumed oxygen can be passed from the gas space via a gas line as a gas outlet to the electrolyte holding vessel. The gas line is preferably submerged below the liquid level of the electrolyte. If the gas line is immersed in the electrolyte holding vessel and the electrolyte discharge line is also simultaneously immersed in the electrolyte collecting vessel, the gas line should preferably be immersed no deeper in the electrolyte holding vessel than the electrolyte discharge line is immersed in the collecting vessel in some cases. The excess oxygen may advantageously be recycled to optimise utilization.

According to a preferred embodiment, the electrolyte holding vessel simultaneously serves as a gas collecting vessel. Such an arrangement has the advantage that only one holding vessel is required for the oxygen and the electrolyte. It is, however, also possible to provide an independent separate receptacle for the oxygen and the electrolyte if desired for any reason. In this case, the electrolyte holding vessel may be arranged if desired beneath the electrolysis cell, wherein the electrolyte is delivered by a pump from an electrolyte holding vessel into an electrolyte feed inlet, provided that the excess electrolyte can preferably freely run away via the overflow channel (verification by free capacity in overflow channel).

In an alternative embodiment, the gas outlet can be connected to a gas collecting vessel and the gas space is shut off from the gap. This means that even in a lower part of the gas space, where the electrolyte flows out from the gap, the electrolyte generally cannot enter the gas space and accumulate therein. The gas space may be shut off from the gap, for example, by use of a plate, for example a metal plate. In such an embodiment, the gas collecting vessel is preferably a separate collecting vessel, into which excess oxygen flows via a gas line as the gas outlet. In this manner, oxygen pressure can generally be adjusted independently of the pressure conditions in the gap. In this embodiment, the gas space preferably has one or more drainage openings at its lower end or at any desired location.

In a preferred embodiment, one or more baffles can optionally be provided in the gap. The baffles can prevent or minimize the electrolyte from falling freely in the gap, such that the flow rate is reduced relative to free fall. At the same time, however, the baffles should preferably not result in a build-up of electrolyte in the gap. The baffles are preferably selected so as to compensate for the pressure drop of the hydrostatic fluid column in the gap. Examples of baffles are generally known, such as from WO 03/042430 and WO 01/57290, both of which are incorporated herein by reference in their entireties.

The baffles may also comprise thin plates, films or the like which include one or more openings to allow the electrolyte to flow through. They can arranged transversely, i.e. perpendicularly or obliquely, to the direction of flow of the electrolyte in the gap. Plate-shaped baffles are often preferably inclined relative to the horizontal, wherein they can be inclined either only in one axis or in both axes. If the baffles are arranged obliquely to the direction of flow, they may be inclined, for example, both in the direction of the ion-exchange membrane and in the direction of the (gas diffusion) electrode. The baffles may furthermore be inclined over the width of the electrochemical cell.

The present invention also provides a process for electrolyzing an aqueous alkali halide solution in an electrochemical cell. Such a process involves an arrangement wherein electrolyte is supplied in excess from an electrolyte holding vessel to an electrolyte feed inlet, the electrolyte flows from an electrolyte feed inlet into the gap and from the gap into an electrolyte drain and flows away from the electrolyte feed inlet via an overflow.

An excess of electrolyte in the electrolyte feed inlet means for the purposes of the present invention that the electrolyte feed inlet is constantly uniformly filled with an electrolyte film over the entire width of the inlet. Accordingly, when the electrolysis cell is in operation, while electrolyte is constantly flowing away via the gap, a certain electrolyte level in the electrolyte feed inlet should simultaneously be present over the entire width of the electrolyte feed inlet. This can be readily accomplished in many cases if a certain quantity of electrolyte is constantly flowing out of the electrolyte feed inlet not only via the gap, but also via the overflow.

The excess of electrolyte which is exhausted via the overflow is preferably from about 0.5 to about 30 vol. %, particularly preferably from about 1 to about 20 vol. %.

It is an important feature that the quantity of electrolyte required by a falling-film cell for trouble-free operation should preferably depend only on the design of the falling-film cell, as opposed to on to selected current densities. The electrolyte excess thus should advantageously be adjusted only once at the beginning of an electrolysis operation and advantageously merely needs to be kept constant during operation. The effective height ratio of h to g should typically be selected such that the electrolyte concentration necessary for optimum operation of the electrolysis cell is established in the gap.

An electrochemical cell according to the invention may be used for different electrolysis processes, such as those wherein at least one electrode is a gas diffusion electrode. The gas diffusion electrode preferably acts as a cathode, particularly preferably as an oxygen-consuming cathode, wherein the gas supplied to the electrochemical cell is a gas containing oxygen, for example air, oxygen-enriched air or oxygen itself. A cell according to the present invention is preferably used for the electrolysis of an aqueous solution of an alkali halide, in particular of sodium chloride.

In the case of electrolysis of an aqueous sodium chloride solution, the gas diffusion electrode can be, for example, a gas diffusion electrode that comprises an electrically conductive support and an electrochemically active coating. The electrically conductive support is preferably a mesh, woven, braided, knitted or nonwoven fabric or foam made of metal, in particular of nickel, silver or silver-plated nickel. The electrochemically active coating preferably comprises a catalyst, for example silver(I) oxide, and a binder, for example polytetrafluoroethylene (PTFE). The electrochemically active coating may comprise one or more layers. A gas diffusion layer, for example made from a mixture of carbon and polytetrafluoroethylene, which is applied onto the support, may additionally be provided.

Electrodes made from titanium may, for example, be used as the anode. The electrodes can optionally be coated, for example, with ruthenium-iridium-titanium oxides or ruthenium-titanium oxide or other coatings.

Any conventional commercial membrane can be used. For example DuPont, Nafion® NX2010 may be used as the ion-exchange membrane.

An electrolysis cell according to the present invention, which is suitable for the electrolysis of an aqueous sodium chloride solution, preferably has a gap between the gas diffusion electrode and the ion-exchange membrane which has a width of preferably from about 0.2 to about 5 mm, particularly preferably from about 0.5 to about 3 mm.

Figure 2:
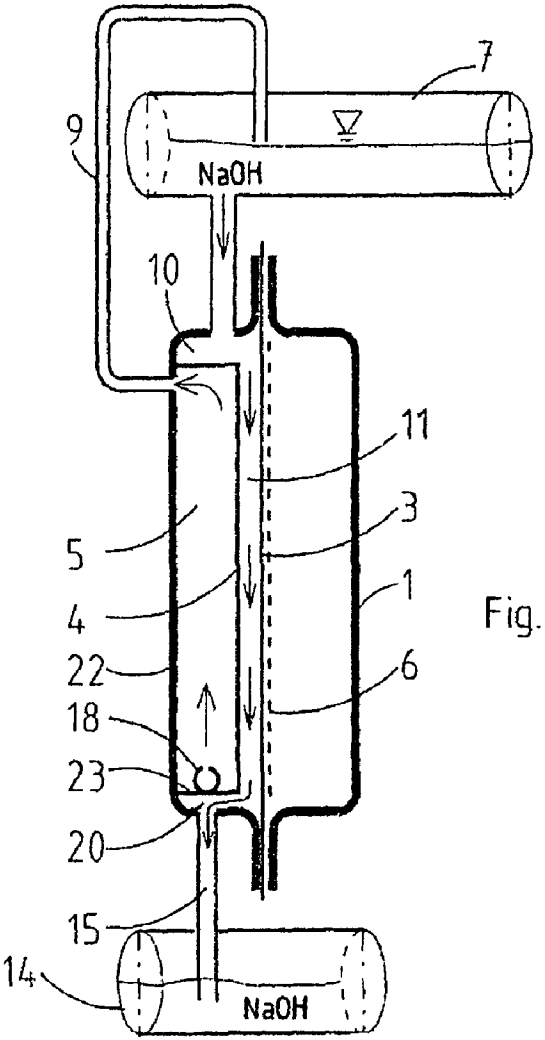
FIG. 2 is a schematic cross-section through the electrolysis cell according to the invention of FIG. 1.

FIG. 1 shows one advantageous embodiment of an electrochemical cell according to the instant invention in longitudinal section. Electrolyte flows from the electrolyte holding vessel 7 via an electrolyte feed line 8 into the electrolyte feed inlet 10 of the electrolysis half-cell with a gas diffusion electrode 4 (FIG. 2). The electrolyte holding vessel 7 is arranged above the electrolyte feed inlet 10. The electrolyte feed inlet 10 runs longitudinally over the entire width of the electrolysis half-cell above the gap 11 (FIG. 2). The difference in height between the liquid level in the holding vessel 7 and the liquid level in the electrolyte feed inlet 10 is designated h.

The electrolyte flows uniformly over the entire width of the electrolysis half-cell via the electrolyte feed inlet 10 from above into the gap 11 (FIG. 2). In the gap 11, the electrolyte flows downwards into the electrolyte drain 20 (FIG. 2), which is open to the gas space 5 (FIG. 2), and from the electrolyte drain 20 via an electrolyte discharge line 15 into an electrolyte collecting vessel 14.

In one particular embodiment, the gas space 5 is divided from the electrolyte drain 20 with a metal plate as a shut-off, for example a metal sheet, 23. In conjunction with an oxygen receptacle (not shown here) which is separate from the receptacle 7, it is thus possible to adjust the oxygen pressure independently of the pressure conditions in the gap 11 and to establish optimum operating conditions for the gas diffusion electrode. Drainage openings (not shown here) make it possible to exhaust any condensate which may arise on the reverse of the gas diffusion electrode.

According to the invention, the electrolysis half-cell comprises an overflow channel 13, which in the embodiment shown is U-shaped, wherein the vertex of the U-shaped channel points upwards. Moreover, in the embodiment shown, an additional overflow channel 12 is provided which is arranged substantially horizontal. Excess electrolyte, which does not flow away in the gap 11, flows via the overflow channel 12 into side channel 21, which is arranged vertically substantially to the side of the electrolysis half-cell and exhausts excess electrolyte downwards. Excess electrolyte is collected in the electrolyte collecting vessel 14.

If the excess of electrolyte is so large that it cannot be exhausted solely via the gap 11 and the overflow channel 12, a proportion of the electrolyte flows away via the U-shaped overflow channel 13 downwards into the side channel 21. The difference in height between the vertex of the overflow channel 13 and the liquid level in the electrolyte feed inlet 10 is denoted g.

Beneath the gap 11, a gas distribution tube 18 with openings 19 runs likewise longitudinally along the electrolysis half-cell, through which openings flows the oxygen from a gas holding vessel 17 into the gas space 5 of the electrolysis half-cell. The gas distribution tube 18 thus forms the gas inlet into the electrolysis half-cell. Unconsumed oxygen may leave the gas space 5 via a gas line 9 as the gas outlet and flow into the electrolyte holding vessel 7. In the embodiment shown, the electrolyte holding vessel 7 simultaneously acts as the gas collecting vessel.

In the embodiment according to FIG. 1, a pump 30 is furthermore provided which pumps electrolyte from the collecting vessel 14 into the holding vessel 7.

FIG. 2 shows the electrolysis cell according to FIG. 1 in cross-section. It comprises an anode half-cell 1 with an anode 6 and a cathode half-cell 22 with a gas diffusion electrode 4 as the cathode. The two half-cells 1, 22 are separated from one another by an ion-exchange membrane 3. A gap 11 is located between the ion-exchange membrane 3 and the gas diffusion electrode 4. A gas space 5 is arranged behind the gas diffusion electrode 4. The gas space 5 thus forms the back space behind the gas diffusion electrode 4.

As shown in FIG. 2, electrolyte flows from the electrolyte feed inlet 10 into the gap 11 and from the gap 11 into the electrolyte drain 20, until the electrolyte, passing via the electrolyte discharge line 15, is finally collected in the electrolyte collecting vessel 14. Gas which flows via the gas distribution tube 18 into the gas space 5 may flow via the gas outlet 9 into the electrolyte holding vessel 7 above the electrolysis cell. A metal plate 23 separates the gas space 5 from the electrolyte drain 20.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

The invention claimed is:

1. An electrochemical cell comprising:

(i) an anode half-cell with an anode, (ii) a cathode half-cell with a cathode comprising a gas diffusion electrode, (iii) an ion-exchange membrane arranged between the anode half-cell and the cathode half-cell, (iv) a gap between the gas diffusion electrode and the ion-exchange membrane, wherein the gas diffusion electrode separates the gap from a gas space, (v) an electrolyte feed inlet positioned above the gap and connected to the gap, (vi) an electrolyte drain beneath the gap, (vii) a gas inlet into the gas space, (viii) a gas outlet out of the gas space, and (ix) an electrolyte holding vessel, wherein the electrolyte holding vessel is connected to an overflow by the electrolyte feed inlet;

wherein the cell is configured to provide the gap with a continuous supply of electrolyte.

2. An electrochemical cell according to claim 1, wherein the electrolyte holding vessel is arranged from about 30 to about 200 cm above the electrolyte feed inlet.

3. An electrochemical cell according to claim 1, wherein the electrolyte holding vessel is connected via a pump with the electrolyte feed inlet.

4. An electrochemical cell according to claim 1, wherein the height of the overflow is from 0 to about 190 cm.

5. An electrochemical cell according to claim 1, wherein the overflow comprises an overflow channel.

6. An electrochemical cell according to claim 5, wherein the overflow channel comprises a U-shaped channel, a vertex of which points upwards.

7. An electrochemical cell according to claim 5, wherein the overflow channel comprises a standpipe or shaft.

8. An electrochemical cell according to claim 1, wherein the gas outlet is connected with the electrolyte holding vessel.

9. An electrochemical cell according to claim 1, wherein the gas outlet is connected with a gas collecting vessel and the gas space is separate from the gap.

10. The electrochemical cell of claim 1 capable of electrolyzing a sodium chloride solution.

11. An electrochemical cell according to claim 10, wherein the overflow comprises an overflow channel.

12. An electrochemical cell according to claim 11, wherein the overflow channel comprises a U-shaped channel, a vertex of which points upwards.

13. An electrochemical cell according to claim 11, wherein the overflow channel comprises a standpipe or shaft.

14. An electrochemical cell according to claim 10, wherein the height of the overflow is from 0 to about 190 cm.

15. An electrochemical cell according to claim 1, wherein the electrolyte holding vessel is arranged at an elevation higher than the electrolyte feed inlet.

16. An electrochemical cell according to claim 15, wherein the electrolyte holding vessel is situated at a higher elevation than the top of the overflow.

17. An electrochemical cell according to claim 16, wherein the height of the overflow is arranged at an elevation that is equal to or higher than the elevation of electrolyte feed inlet.

18. An electrochemical cell according to claim 10, wherein the electrolyte holding vessel is situated at a higher elevation than the top of the overflow.

19. An electrochemical cell comprising:

(i) an anode half-cell with an anode;

(ii) a cathode half-cell with a cathode comprising a gas diffusion electrode;

(iii) an ion-exchange membrane arranged between the anode half-cell and the cathode half-cell;

(iv) a gap between the gas diffusion electrode and the ion-exchange membrane, wherein the gas diffusion electrode separates the gap from a gas space;

(v) an electrolyte feed inlet positioned above the gap and connected to the gap;

(vi) an electrolyte drain beneath the gap;

(vii) a gas holding vessel that connects to the gas space through a gas inlet;

(viii) a gas outlet that runs from the gas holding vessel into the electrolyte holding vessel; and (ix) an electrolyte holding vessel connected to an overflow by the electrolyte feed inlet, wherein the electrolyte holding vessel is situated at a higher elevation than the electrolyte feed inlet and the top of the overflow; and wherein the electrochemical cell is capable of electrolyzing a sodium chloride solution; and wherein the cell is configured to provide the gap with a continuous supply of electrolyte.

* * * * *